US006285847B1

(12) United States Patent
Tanizaki et al.

(10) Patent No.: US 6,285,847 B1
(45) Date of Patent: Sep. 4, 2001

(54) PRINTER

(75) Inventors: Junichi Tanizaki, Fukuoka-ken; Yuzo Kawano, Ogori; Yoshiaki Ijima, Dazaifu; Kazuhiko Tajima, Chikushino, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/487,208

(22) Filed: Jan. 19, 2000

(30) Foreign Application Priority Data

Jan. 20, 1999 (JP) ..... 11-011764

(51) Int. Cl.[7] ..... G03G 15/00; G03G 15/08
(52) U.S. Cl. ..... 399/167; 399/75
(58) Field of Search ..... 399/75, 167, 36, 399/107, 222, 252, 88

(56) References Cited

U.S. PATENT DOCUMENTS 5,258,811 * 11/1993 Miyake et al. ..... 399/167
5,508,793 * 4/1996 Kimura et al. ..... 399/63
5,528,343 * 6/1996 Tada et al. ..... 399/167 X
5,768,656 * 6/1998 Nagasue et al. ..... 399/75
6,016,416 * 1/2000 Kitamura ..... 399/167
6,125,253 * 9/2000 Tashima et al. ..... 399/167

FOREIGN PATENT DOCUMENTS 08-146826 * 6/1996 (JP) .
08-334943 * 12/1996 (JP) .

* cited by examiner

*Primary Examiner*—Sophia S. Chen
(74) *Attorney, Agent, or Firm*—Stevens, Davis, Miller & Mosher, LLP

(57) ABSTRACT

A printer for forming a toner image to be transferred onto a work piece, includes a latent image roller with an outer peripheral image surface adapted to be electrified in such a manner that an electrostatic latent image is formed thereon, an image developing roller with an outer peripheral toner surface adapted to hold thereon toner to be supplied onto the outer peripheral image surface so that the electrostatic latent image is developed by the toner to form the toner image, an electrifier for electrifying the outer peripheral image surface, and a discharger for partially electrically discharging the electrified outer peripheral image surface to form the electrostatic latent image. A motor drives both the latent image roller and the image developing roller.

13 Claims, 4 Drawing Sheets

PRINTER

BACKGROUND OF THE INVENTION AND RELATED ART STATEMENT

The present invention relates to a printer for forming a toner image to be transferred onto a work piece.

In a prior art printer, a latent image roller adapted to be electrified in such a manner that an electrostatic latent image is formed thereon transmits a torque from a motor to an image developing roller for holding thereon toner to be supplied onto the latent image roller so that the electrostatic latent image is developed by the toner to form a toner image.

OBJECT AND SUMMARY OF THE INVENTION

An object of the present invention is to provide a printer in which a position and shape of a latent image roller is correctly kept, and/or a rotational movement of the latent image roller is correctly controlled.

In a printer for forming a toner image to be transferred onto a work piece, comprising, a latent image roller including an outer peripheral image surface adapted to be electrified in such a manner that an electrostatic latent image is formed thereon, an image developing roller including an outer peripheral toner surface adapted to hold thereon toner to be supplied onto the outer peripheral image surface so that the electrostatic latent image is developed by the toner to form the toner image, an electrifier for electrifying the outer peripheral image surface, and a discharger for electrically discharging partially the electrified outer peripheral image surface to form the electrostatic latent image, it is preferable that a motor drives both the latent image roller and the image developing roller.

If the image developing roller is prevented from being driven through the latent image roller by the motor, a driving force for driving the image developing roller does not affect a position of the latent image roller, a shape deformation of the latent image roller and a rotational movement of the latent image roller. If the printer comprises an intermediate rotational member connected to the motor to be rotationally driven by the motor and including a rotational part mechanically connected to the image developing roller to drive the image developing roller and another rotational part mechanically connected to the latent image roller to drive the latent image roller so that an output torque of the motor is divided at the intermediate rotational member into a first part torque to be supplied to the image developing roller and a second part torque to be supplied to the latent image roller, the driving force of the first part torque for driving the image developing roller is not supplied to the latent image roller, so that the shape, position and rotational movement of the latent image roller can be correctly or desirably kept.

If a first teethed pulley is connected to the motor to be driven by the motor, a second teethed pulley is connected to the latent image roller to drive the latent image roller, a teethed belt includes teeth for engaging both the first and second teethed pulleys to drive the latent image roller by the motor, and the teeth of the belt is formed of an elastomer, the rotational movement of the latent driven by the motor through the elastomer teeth belt is kept smooth or constant by a large-area and low-rigidity engagement between the elastomer teeth belt and the teethed pulleys for compensating errors in shape and positional relationship of a force transmission mechanism for the latent image roller. It is desirable that the image developing roller is prevented from being driven through the teethed belt for driving the latent image roller. It is desirable that the image developing roller is prevented from being mechanically connected through the latent image roller to the motor. It is desirable that the image developing roller is prevented from being mechanically connected through the teethed belt to the motor.

If the intermediate rotational member connected to the motor to be rotationally driven by the motor includes a first teethed pulley and another rotational part mechanically connected to the image developing roller to drive the image developing roller so that an output torque of the motor is divided at the intermediate rotational member into a first part torque to be supplied to the first teethed pulley and a second part torque to be supplied to the image developing roller through the another rotational part, a second teethed pulley connected to the latent image roller to drive rotationally the latent image roller, and a teethed belt including teeth engages both the first and second teethed pulleys to drive rotationally the latent image roller by the first part torque while the second part torque is prevented from being transmitted by the teethed belt, and the teeth of the belt is formed of an elastomer, the smooth and constant rotational movement of the latent image roller obtained by being driven through the elastomer teeth belt is not affected by the second part torque for the image developing roller. That is, it is preferable that the image developing roller is prevented from being driven through the teethed belt for driving the latent image roller.

If the image developing roller is driven through an Oldham's coupling by the motor, the Oldham's coupling absorbs errors in position and attitude of the image developing roller so that a positional relationship between the image developing roller and the latent image roller facing to each other is not affected by an undesirable stress for absorbing the errors in position and attitude of the image developing roller.

If a coupling pair of a first coupling part including at least one pair of radially outer (inner peripheral) teeth (arranged on an inner periphery of the part), and a second coupling part including at least one pair of radially inner (outer peripheral) teeth (arranged on an outer periphery of the part) is arranged between the motor and the latent image roller to transmit a driving force from the motor to the latent image roller, one of the first and second coupling parts is mechanically connected to the motor, another of the first and second coupling parts is mechanically connected to the latent image roller, and the radially outer teeth and the radially inner teeth face to each other radially and circumferentially and engage each other to transmit a part of torque generated by the motor to the latent image roller, an engaging area and a mutual engaging number of the radially inner and outer teeth are increased in comparison with those obtained by a mutual engage between outer peripheral teeth gears whose teeth are arranged on an outer periphery of the gears so that the rotational movement of the latent driven by the motor through the coupling pair as limited above is kept smooth or constant. The radially outer teeth and the radially inner teeth extend axially and radially to face to each other circumferentially.

If the radially outer teeth and the radially inner teeth are involute teeth respectively, the rotational movement of the latent driven by the motor through the coupling pair is not affected by a positional relationship between the first and second coupling parts or a distance between rotational axes of the first and second coupling parts.

If the radially outer teeth substantially are opposite radially to each other relative to a rotational axis of the coupling pair, and the radially inner teeth substantially are opposite radially to each other relative to the rotational axis of the coupling pair so that the radially inner and radially outer teeth engage each other at both radial sides opposite to each other relative to the rotational axis of the coupling pair to restrain an engagement between the radially inner and outer teeth from generating a radial force to be applied to the latent image roller when transmitting the part of torque to the latent image roller through the engagement therebetween or the radial forces generated respectively at the radial sides opposite to each other relative to the rotational axis of the coupling pair balance each other, the latent image roller is not deformed by the radial force generated by the coupling pair.

If the radially outer and inner teeth are arranged in respective rows along a circumferential direction of the coupling pair so that a transmission of the part of torque is distributed along the circumferential direction of the coupling pair, the engaging area and a mutual engaging number of the radially inner and outer teeth are further increased so that the rotational movement of the latent driven by the motor through the coupling pair as limited above is made more smooth or constant.

It is preferable as an embodiment that the first coupling part includes a spline shaft on which the radially inner teeth are formed, and the second coupling part includes a spline hole on which the radially outer teeth are formed.

If a toner supplying member urges the toner toward the image developing roller, and a clutch controls a torque transmission from the motor to the toner supplying member, a load variation of the motor according to the toner supply is decreased.

DETAILED DESCRIPTION OF PREFERRED EMBODIMENTS

Figure 1:
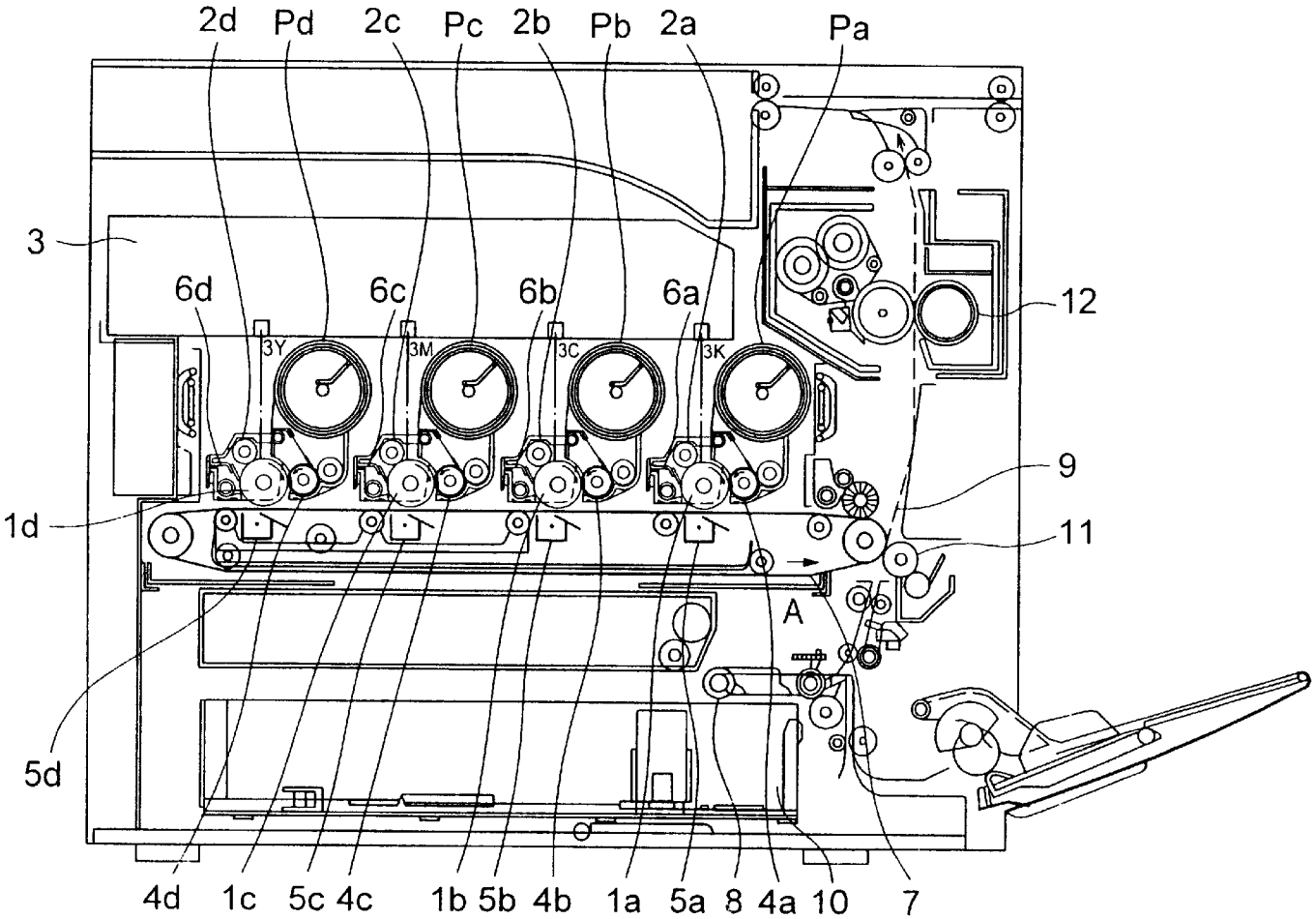
FIG. 1 is a schematic front view showing a printer of the invention.
Figure 2A:
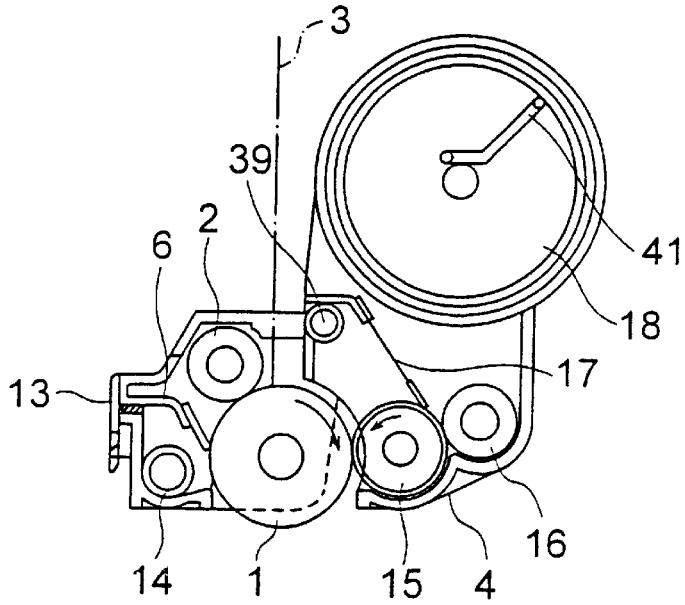
FIG. 2A is an enlarged front view of a toner image forming mechanism of the invention.
Figure 2B:
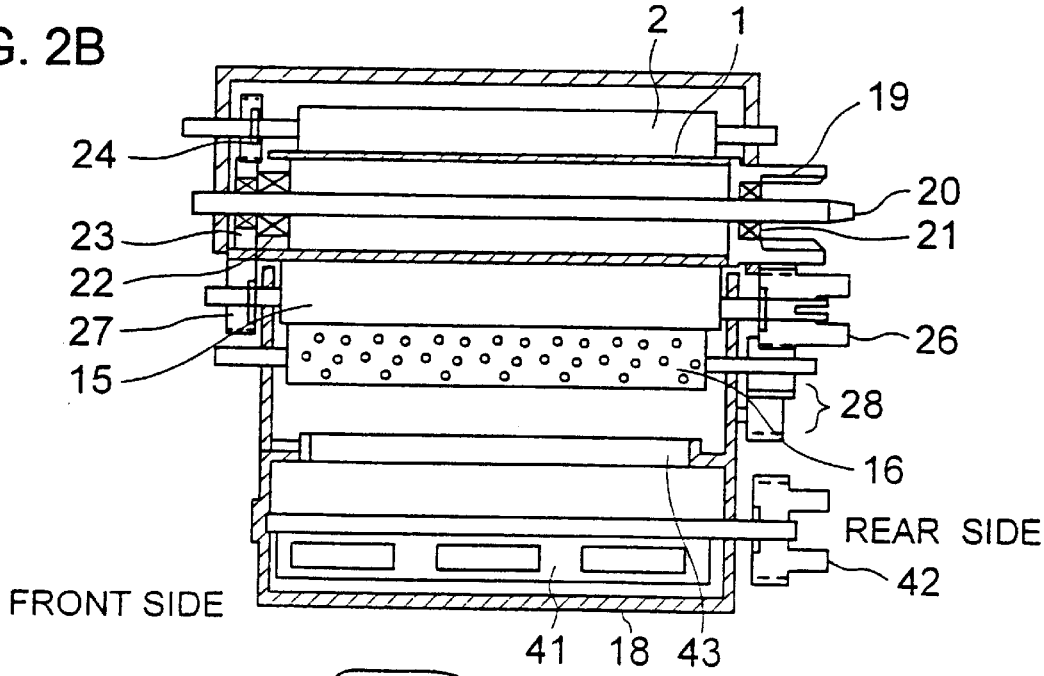
FIG. 2B is an elevation view of the toner image forming mechanism of the invention as seen from an upper side of FIG. 2A.
Figure 2C:
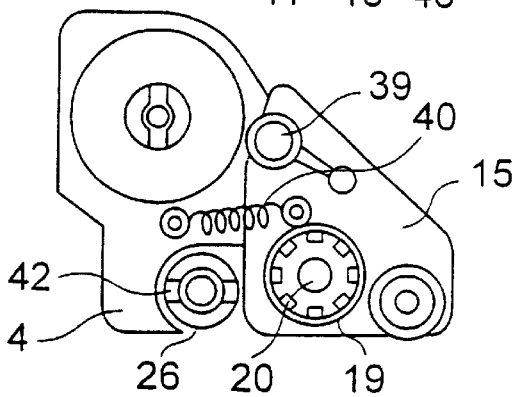
FIG. 2C is a back view of the toner image forming mechanism of the invention as seen from a rear side of FIG. 2B.
Figure 3:
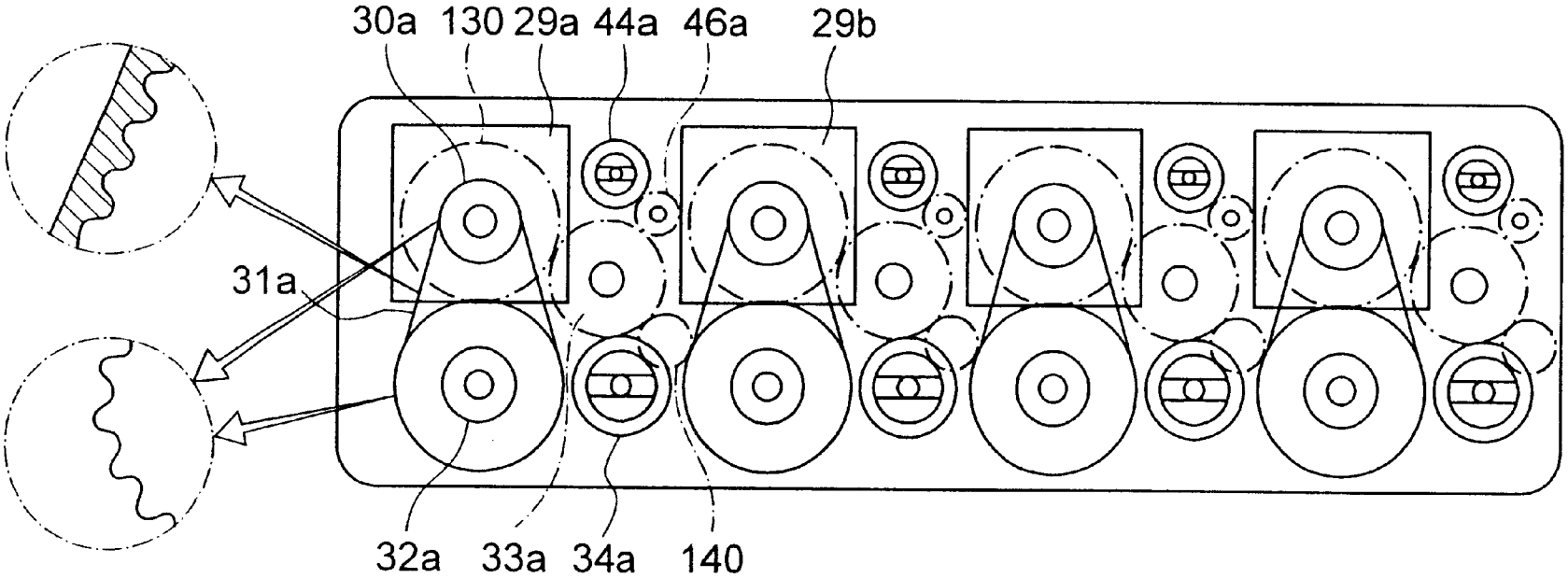
FIG. 3 is a schematic view showing a torque transmission mechanism from a motor to a latent image roller and an image developing roller.
Figure 4:
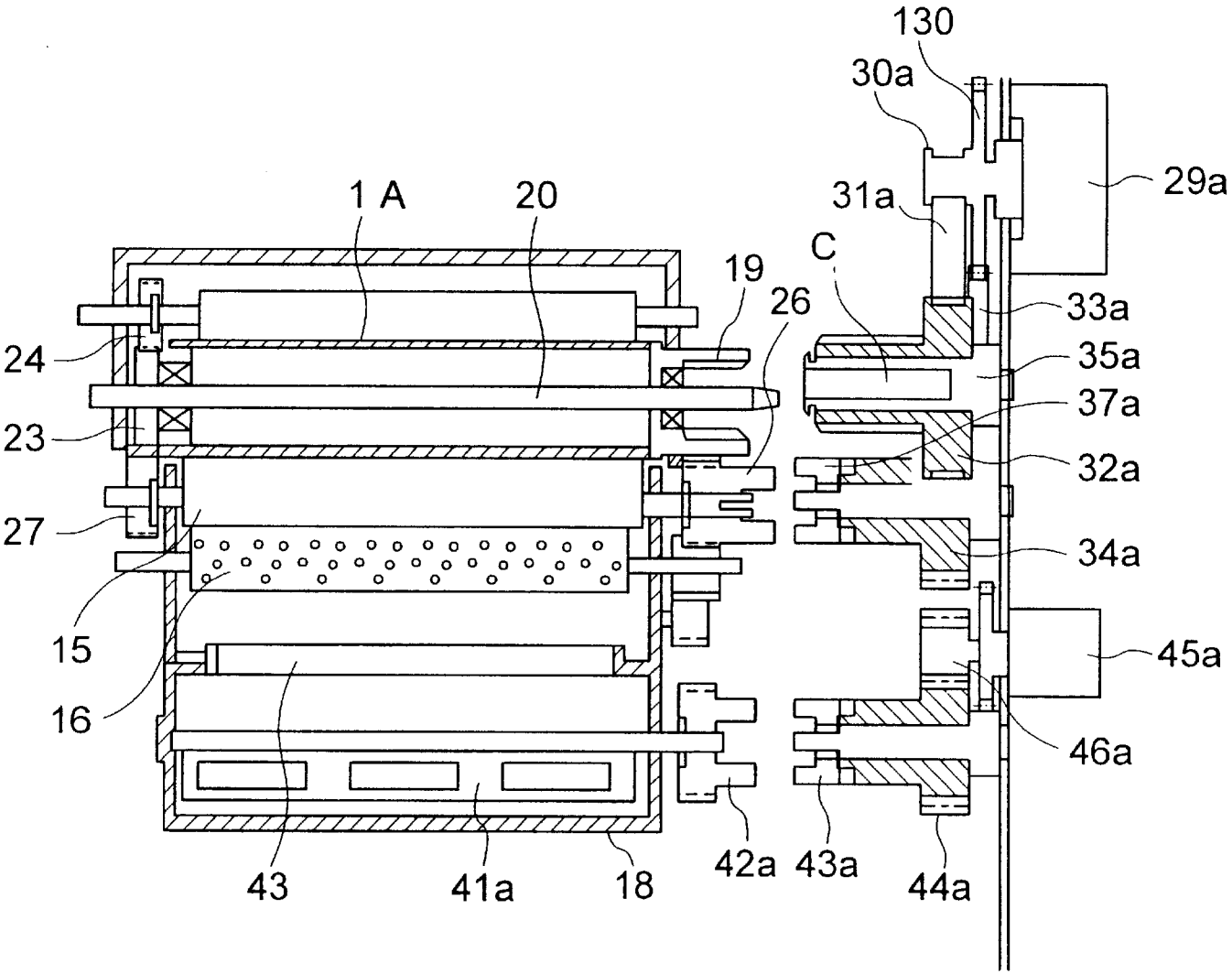
FIG. 4 is a partially cross-sectional view showing a torque transmission mechanism when disassembled from a printer unit.

A preferred embodiment of the invention is shown in FIGS. 1–4. A printer has four printing units Pa, Pb, Pc and Pd. Each of the printing units has a photosensitive roller 1*a*–1*d* (as the claimed latent image roller) whose outer peripheral image surface is electrified or charged with static elasticity by an electrifier roller 2*a*–2*d* light beam projector 3 for projecting a light beam (3K, 3C, 3M, 3Y) to the outer peripheral image surface to partially electrically discharge the electrified outer peripheral image surface by a light beam spot so that a latent image is formed, an image developing roller 15 of a developing device 4*a*–4*d* whose outer peripheral toner surface holds thereon toner to be transferred onto the outer peripheral image surface so that the electrostatic latent image is developed by the toner to form the toner image, a transfer device 5*a*–5*d* for drawing the toner image to an endless transfer belt 7 from the outer peripheral toner surface, and a cleaning device 6*a*–6*d* for removing from the outer peripheral image surface before being electrified again a remainder of the toner which has not transferred to the transfer belt 7.

In accordance with a movement of the transfer belt 7 as indicated by an arrow A, the printing units Pa, Pb, Pc and Pd form respective toner images of black toner, cyan toner, magenta toner and yellow toner on the transfer belt 7. The toner is charged on the outer peripheral toner surface with static electricity, is drawn onto the electrified outer peripheral image surface by electric potential difference between the outer peripheral toner surface and the outer peripheral image surface, and is drawn or transferred onto the transfer belt 7 by reversed electrical potential of the cleaning device 6*a*–6*d* relative to the electrical potential of the toner on the outer peripheral toner surface.

A combination of the toner images formed on the transfer belt 7 by the printing units Pa, Pb, Pc and Pd is transferred onto a work sheet 9 supplied from a sheet conainer 10 by a sheet feed roller 8 when the work sheet 9 with the combination of the toner images is compressed between a pair of compression rollers 11. The combination of the toner images on the work sheet 9 is heated to be fixed to the work sheet 9 by a fixing device 12.

The photosensitive roller 1 has an involute spline hole 19 at a rear side end thereof, and is supported on a drum shaft 20 in a rotatable manner through rotary bearings 21 and 22 so that the electrifier roller 2*a*–2*d* and the photosensitive roller 1*a*–1*d* rotate together with a contact therebetween. The remainder of the toner removed from the outer peripheral image surface by the cleaning device 6*a*–6*d* pressed against the outer peripheral image surface is fed to an outside of the printing unit by a toner waste feed screw 14.

The toner is supplied by a toner supply roller 16 from a toner container 18 onto the image developing roller 15, and is electrically charged by a toner blade 17 while its thickness is determined by the toner blade 17.

The image developing roller 15 whose outer peripheral toner surface is formed of an electrically conductive elastomer is swingable on a rotational center pin 39 and is pressed against the photosensitive roller 1 by a spring 40.

A combination of a teethed pulley 30*a* and a teethed gear 130 as the claimed intermediate rotational member is mounted on and rotationally driven by a motor 29*a*–29*b*. A teethed belt 31*a* whose teeth is formed by an elastomer connects and engage the teethed pulley 30*a* and a teethed pulley 32*a* which is rotatable on a shaft 35*a* and includes an involute spline shaft, so that the involute spline shaft is rotationally driven through the teethed belt 31*a* by the motor 29*a*–29*b*. The teethed gear 130 is connected to an Oldham's coupling part 34*a* through idle gears 33*a* and 140 as a gear train 28 to rotationally drive an Oldham's coupling engage portion 37*a*.

The involute spline shaft is inserted into with a guide between the drum shaft 20 and a hole C of the teethed pulley 32*a* and engage an involute spline hole 19 coaxially fixed to the photosensitive roller 1 so that the photosensitive roller 1 is rotationally driven through the claimed intermediate rotational member, teethed belt and coupling pair by the motor.

The Oldham's coupling engage portion 37*a* engage an Oldham's coupling engage portion 26 coaxially fixed to the image developing roller 15 so that the image developing roller 15 is driven through the Oldham's coupling by the motor 29*a*–29*b*.

A toner agitator 41*a* in the toner container 18 is rotationally driven through an Oldham's coupling part 42 fixed to the toner agitator 41*a* with a coaxial relationship between the Oldham's coupling part 42*a* and an rotational axis of the toner agitator 41*a*, an Oldham's coupling engage portion 43*a* fixed to a rotatable Oldham's coupling part 44*a* mating with a clutch gear 46*a*, and an electromagnetic clutch 45 which connects and disconnect a torque transmission between the clutch gear 46*a* and the idle gears 33*a*.

The toner waste feed screw 14 is rotationally driven through a gear 27 coaxially fixed to the image developing roller 15, and an idle gear 23 freely rotatable on the drum shaft 20, and the electrifier roller 2*a*–2*d* is rotationally driven through the gear 27, the idle gear 23 and a gear 24 coacially fixed to the electrifier roller 2*a*–2*d*.

What is claimed is:

1. A printer for forming a toner image to be transferred onto a work piece, said printer comprising:

a latent image roller including an outer peripheral image surface for being electrified to form an electrostatic latent image thereon, an image developing roller including an outer peripheral toner surface for holding thereon toner to be supplied onto the outer peripheral image surface so that the electrostatic latent image is developed by the toner to form the toner image, and a motor for driving the latent image roller and the image developing roller, wherein the printer further comprises a first teethed pulley connected to the motor to be driven by the motor, a second teethed pulley connected to the latent image roller to drive the latent image roller, and a teethed belt including teeth for engaging both the first and second teethed pulleys to drive the latent image roller by the motor, wherein the teeth of the belt are formed of an elastomer.

2. A printer according to claim 1, wherein the image developing roller is prevented from being driven through the teethed belt by the motor.

3. A printer according to claim 1, wherein the image developing a roller is prevented from being mechanically connected through the teethed belt to the motor.

4. A printer for forming a toner image to be transferred onto a work piece, said printer comprising:

a latent image roller including an outer peripheral image surface for being electrified to form an electrostatic latent image thereon, an image developing roller including an outer peripheral toner surface for holding thereon toner to be supplied onto the outer peripheral image surface so that the electrostatic latent image is developed by the toner to form the toner image, and a motor for driving the latent image roller and the image developing roller, wherein the printer further comprises an intermediate rotational member connected to the motor to be rotationally driven by the motor and including a first teethed pulley and another rotational part mechanically connected to the image developing roller to drive the image developing roller so that an output torque of the motor is divided at the intermediate rotational member into a first part torque to be supplied to the first teethed pulley and a second part torque to be supplied to the image developing roller through the another rotational part, a second teethed pulley connected to the latent image roller to drive rotationally the latent image roller, and a teethed belt including teeth for engaging both the first and second teethed pulleys to drive rotationally the latent image roller by the first part torque, wherein the teeth of the teethed belt are formed of an elastomer.

5. A printer according to claim 4, wherein the image developing roller is prevented from being driven through the teethed belt for driving the latent image roller.

6. A printer for forming a toner image to be transferred onto a work piece, said printer comprising:

a latent image roller including an outer peripheral image surface for being electrified to form an electrostatic latent image thereon, an image developing roller including an outer peripheral toner surface for holding thereon toner to be supplied onto the outer peripheral image surface so that the electrostatic latent image is developed by the toner to form the toner image, and a motor for driving the latent image roller and the image developing roller, wherein the printer further comprises a coupling pair of a first coupling part including at least one pair of radially outer teeth, and a second coupling part including at least one pair of radially inner teeth, wherein the radially outer teeth and the radially inner teeth face each other radially and circumferentially and engage each other to transmit a torque generated by the motor to the latent image roller.

7. A printer according to claim 6, wherein the radially outer teeth and the radially inner teeth extend axially and radially to face to each other circumferentially.

8. A printer according to claim 6, wherein the radially outer teeth and the radially inner teeth are involute teeth.

9. A printer according to claim 6, wherein the radially outer teeth substantially are opposite radially to each other relative to a rotational axis of the coupling pair, and the radially inner teeth substantially are opposite radially to each other relative to the rotational axis of the coupling pair, so that the radially inner and radially outer teeth engage each other at both radial sides opposite to each other relative to the rotational axis of the coupling pair to restrain an engagement between the radially inner and outer teeth from generating a radial force to be applied to the latent image roller when transmitting the torque to the latent image roller through the engagement therebetween.

10. A printer according to claim 6, wherein the radially outer and inner teeth are arranged in respective rows along a circumferential direction of the coupling pair so that a transmission of the torque is distributed along the circumferential direction of the coupling pair.

11. A printer according to claim 6, wherein the first coupling part includes a spline shaft on which the radially inner teeth are formed, and the second coupling part includes a spline hole on which the radially outer teeth are formed.

12. A printer for forming a toner image to be transferred onto a work piece, said printer comprising:

a latent image roller including an outer peripheral image surface for being electrified to form an electrostatic latent image thereon, an image developing roller including an outer peripheral toner surface for holding thereon toner to be supplied onto the outer peripheral image surface so that the electrostatic latent image is developed by the toner to form the toner image, and a motor for driving the latent image roller and the image developing roller, wherein the printer further comprises a toner supplying member for urging the toner toward the image developing roller, and a clutch for controlling a torque transmission from the motor to the toner supplying member.

13. A printer for forming a toner image to be transferred onto a work piece, said printer comprising:

a latent image roller including an outer peripheral image surface for being electrified to form an electrostatic latent image thereon, an image developing roller including an outer peripheral toner surface for holding thereon toner to be supplied onto the outer peripheral image surface so that the electrostatic latent image is developed by the toner to form the toner image, and a motor for driving the latent image roller and the image developing roller, wherein the printer further comprises an elastomer element through which the latent image roller is driven by the motor.

* * * * *